US006567996B2

(12) United States Patent
Rao

(10) Patent No.: US 6,567,996 B2
(45) Date of Patent: May 27, 2003

(54) DRAIN LOCK

(75) Inventor: Peter C. Rao, Lake Grove, NY (US)

(73) Assignee: Richard W. Chocko, West Islip, NY (US)

( * ) Notice: Subject to any disclaimer, the term of this patent is extended or adjusted under 35 U.S.C. 154(b) by 0 days.

(21) Appl. No.: 10/267,891

(22) Filed: Oct. 9, 2002

(65) Prior Publication Data

US 2003/0033663 A1 Feb. 20, 2003

Related U.S. Application Data

(63) Continuation-in-part of application No. 09/778,648, filed on Feb. 8, 2001, now abandoned.

(51) Int. Cl.[7] ..... A47K 1/14
(52) U.S. Cl. ..... 4/286; 4/287; 4/292; 4/DIG. 14
(58) Field of Search ..... 4/286, 287, 290, 4/292, 293, DIG. 14; 285/191, 185; 210/163, 164

(56) References Cited

U.S. PATENT DOCUMENTS 576,790 A 2/1897 O'Brien
652,667 A 6/1900 Dickinson
1,107,363 A 8/1914 Schmidt
1,181,319 A 5/1916 Kirkley
1,524,306 A * 1/1925 Pearch ..... 285/191
1,618,679 A * 2/1927 Schifter ..... 4/292
1,746,683 A * 2/1930 Schifter ..... 4/287
1,811,852 A 6/1931 Judell
2,236,886 A 4/1941 Zinkil et al.
2,531,721 A 11/1950 Brock
2,800,231 A * 7/1957 Hicks ..... 4/292
2,896,223 A * 7/1959 Treslo ..... 4/286
3,287,742 A 11/1966 Gaddis
3,445,867 A 5/1969 Loffler
4,447,918 A 5/1984 Cuschera
4,936,338 A 6/1990 Fonoimoana
5,165,118 A 11/1992 Cendrowski
6,092,244 A 7/2000 Rizzardi et al.
6,095,179 A 8/2000 Smith
6,330,724 B1 * 12/2001 Belle ..... 4/286

* cited by examiner

*Primary Examiner*—Timothy L. Maust
*Assistant Examiner*—Khoa Huynh
(74) *Attorney, Agent, or Firm*—Stephen E. Feldman

(57) ABSTRACT

A lock for holding a drain screen in place on the end of a drainpipe has a bolt passing through the screen and screwed into a lateral bore of a cross brace within the drainpipe. The cross brace has an elongated body with a longitudinal bore having left and right threaded rods for easy insertion and the bolt has a non-standard head to thwart removal thereof.

8 Claims, 4 Drawing Sheets

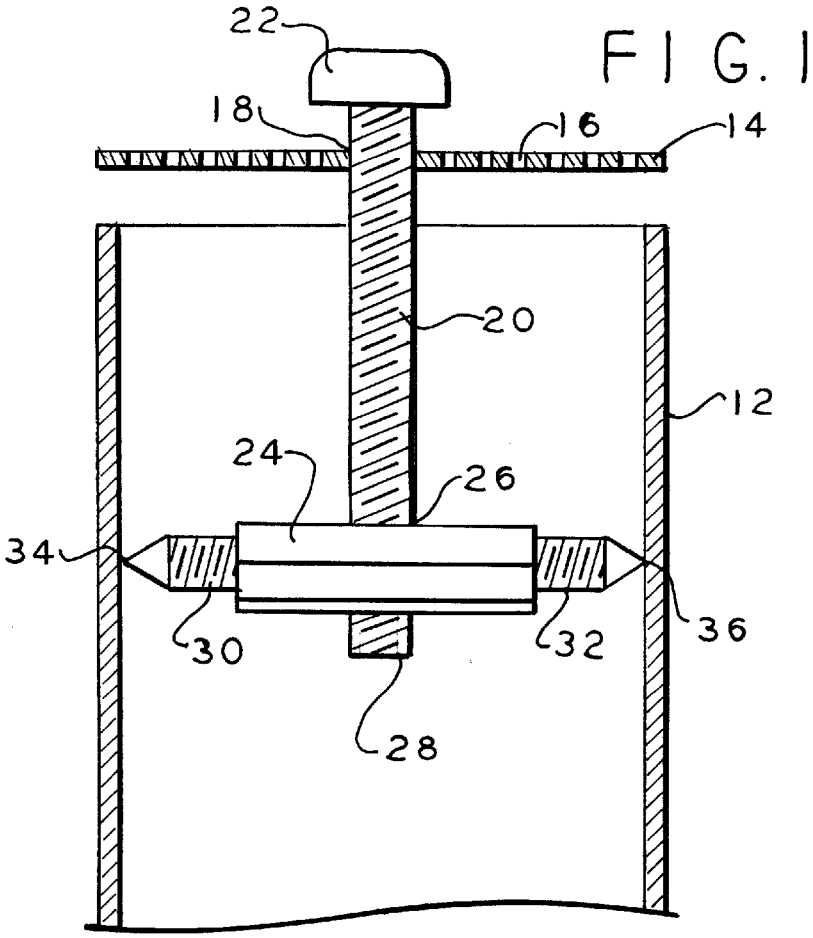
FIG. 1
FIG. 2
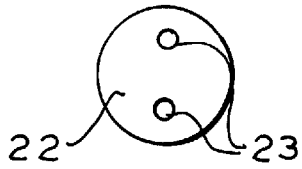
FIG. 3
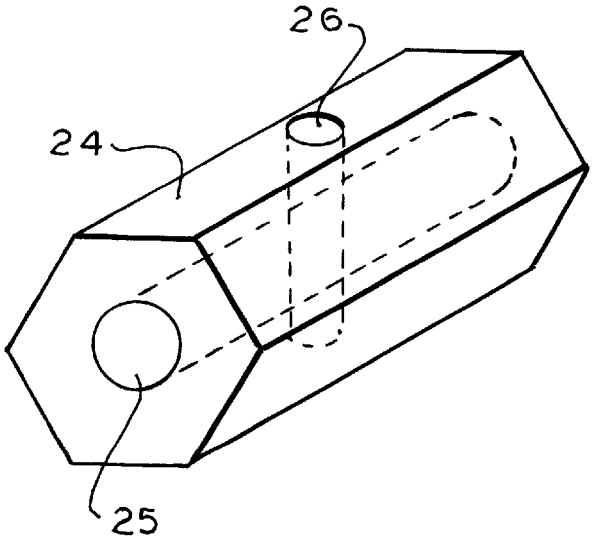

DRAIN LOCK

This is a continuation-in-part of Ser. No. 09/778,648 filed Feb. 8, 2001, now abandoned.

BACKGROUND OF THE INVENTION:

FIG. 1 shows a vertical drainpipe 12 which may be of any conventional size, e.g. 3 inch, 4 inch, 6 inch inside diameter and made of any conventional material, pvc, cast iron, etc. Such drainpipes are conventionally laid under a concrete floor such as in a basement or industrial building with the vertical portion as shown in FIG. 1 used to form a floor drain. The concrete is usually intended to be pitched toward the floor drain so that any water will run toward the drain. A drain screen such as screen 14 in FIG. 1 is conventionally used to prevent waste products and debris from being carried into the floor drain and causing blockage of the under floor main sewer pipe.

Usually such drain screens are very effective in preventing large undesirable pieces of trash or debris from reaching the sewer pipe but when such pieces are caught on the outer surface of the screen it is a difficult and distasteful job to remove them. The easy way out for an unthinking or unmotivated person is to remove the drain screen and flush all of the dirt, including the large pieces, down the drain. The inevitable result is that the under floor sewer pipe will be blocked, resulting in an even more difficult, distasteful, and expensive job to clean the under floor sewer pipe.

DESCRIPTION OF THE PRIOR ART

Brock U.S. Pat. No. 2,531,721 has a screen over a floor drain sump and a circular body below the sump with a central opening and a pushrod vertically moveable in that opening. A float is secured to the lower end of the pushrod and in case of a sewer backup or flood the float will be raised by the incoming backup water causing the pushrod and the float to rise and seal against the bottom of the circular body. When the backup water recedes, the screen is readily removable to access the pushrod and manually move it down in case it does not move down by gravity.

U.S. Pat. No. 3,287,742 to Gaddis discloses a cylindrical housing with an upper edge for forcing a tight seal against the lower surface around the opening in a shower stall pan. A screen inside the housing has a circular lip that rest against the upper surface of the pan in the circular area around the opening. The screen can be drawn down tight by a threaded rod extending upwardly from a diametric cross brace. The brace is brazed or welded to the inside wall of the housing.

Loeffler U.S. Pat. No. 3,445,867 is similar to Gaddis in having a screen held by a bolt threaded into a cross brace. However the cross brace is held in slots cut in the drain pipe inside wall.

The patent of Fonoimoana (4,936,3381) discloses a structure similar to Brock with a floating seal on a pushrod. However in this patent the pushrod is suspended from the center of the screen rather than being supported by a cross brace.

U.S. Pat. No. 6,092,244 discloses a locking grate device for a floor drain in which a cross brace is held by two diametric sliding unthreaded rods. The rods are pointed to grip the inside wall of the drainpipe. The inner ends of the rods are tapered and are moved diametrically outward by cam action of the tapered end of a central bolt which engages the tapered rod ends. The central bolt also serves to hold a drain screen in place so the screen is difficult to remove.

The U.S. Pat. No. 6,095,179 patent to Smith discloses a Flood Control valve having a buoyant valve member, such as a rubber ball which floats against an annular seat to prevent entry of back flowing water. The valve member is held near the seat by two cross members each of which have a central turnbuckle-like body and pointed bolts which grip the inside wall of the drain pipe.

SUMMARY OF THE INVENTION

Since it is difficult to find people who are willing to clean drains the proper way, it becomes necessary to prevent cleaning people from taking the easy way out. The present invention enables a drain screen to be secured into place so that people without the proper tools cannot remove the drain screen.

It is thus an object of the present invention to prevent easy removal of a drain screen.

Another object of this invention is to facilitate a positive interconnection between a drain screen and its drainpipe, thereby making removal of the drain screen much more difficult. In addition the invention allows for much larger variance in the inner dimension of the drainpipe with which it can be used.

A further object of this invention is to provide a simple to install and stable connection between the drainpipe and the drain screen.

It is thus a principal objective of this invention to provide a thrust bolt which extends through a central opening in a drain screen and a bolt receiving means into which the thrust bolt can be screwed. The thrust bolt has a non-standard head, one that requires a special tool to rotate the bolt, such as a spanner wrench with two projections. The bolt receiving means is a cross brace having left and right hand threaded rods with ends for gripping the drainpipe inner wall at diametrically opposed positions. These ends may be pointed and project diametrically outward and into the drainpipe inner walls when the cross brace, which is preferably an elongated, threaded body, is rotated. That elongated body has a lateral through bore with associated threads to receive the thrust bolt.

BRIEF DESCRIPTION OF THE DRAWINGS

Further advantages of the present invention will be apparent to those skilled in the art in view of the attached specification and drawings in which:

FIG. 1 is a vertical side view, partly in section, showing a drain lock constructed in accordance with the present disclosure positioned through a drain screen and in a drainpipe;

FIG. 2 is a top view of a thrust bolt of the drain lock of FIG. 1, showing the head thereof;

FIG. 3 is a perspective view of an elongated body of the drain lock of FIG. 1;

DETAILED DESCRIPTION OF THE INVENTION

Figure 4:
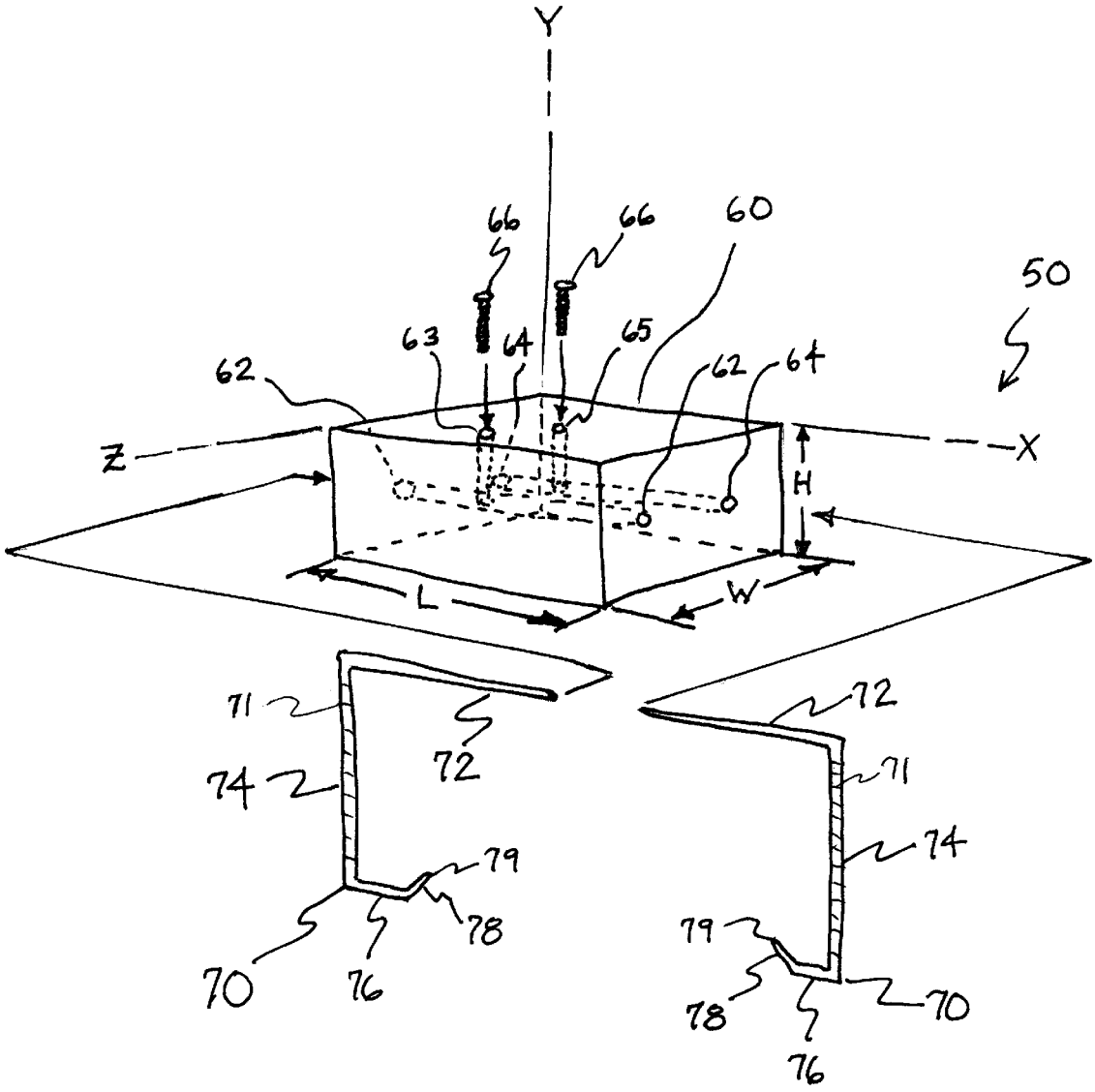
FIG. 4 is a perspective view of a tool for installing and removing the drain lock constructed in accordance with the present disclosure.

Referring now in specific detail to the drawings in which like referenced numerals identify similar or identical elements throughout the several views, and initially to FIG. 1, a novel drain lock system 10 is shown having a thrust bolt 20, a cross member 40, and a tool 50 (see FIG. 4). Cross member 40 includes a body 24 connect to a first rod 30 and a second rod 32. As illustrated in FIG. 1 a vertical portion drainpipe 12 which may be of any conventional size, has a drain screen 14 positioned over the upper end to prevent entry of trash, debris, and scrap which would clog the sewer pipe downstream from the drainpipe. The drain screen 14 conventionally has a plurality of opening 16 over its surface and usually has some means such as a screwdriver slot to facilitate easy removal of the screen.

To the contrary in the present invention there is no means for easy removal of the drain screen 14. Instead easy removal is effectively prevented by thrust bolt 20 which passes through a central opening 18 in drain screen 14. Bolt 20 has a non-standard head 22 which cannot be readily gripped and rotated by anything except a special tool. There are various types of such bolts are available, in this case, as shown in FIG. 2 by way of example and not of limitation, a spanner head bolt is shown. In order to rotate a bolt with such a head, particularly to loosen it once tightened, it is necessary to use a special spanner wrench having two projections which fit into holes 23.

Elongated body 24 preferably has a hexagon shaped cross section so it can be conveniently gripped by an open-end wrench or a pair of pliers. Body 24 is tubular with a longitudinal bore 25 therethrough and has associated threads such as threads on its inner wall or threaded nuts secured to the ends thereof One end of the bore has a left hand thread and the other end has a right hand thread. As viewed in FIG. 1 body 24 has left hand threaded rod 30 projecting from its left end and right hand threaded rod 32 projecting from its right end. The rods 30 and 32 preferably have pointed ends 34, 36, respectively, which seat into and remain securely attached to the inner wall of drainpipe 12. Other end shapes can be used, such as a chisel point. When body 24 is rotated and threaded rods 30 and 32 are held stationary, each rod will move outwardly in a manner similar to rotating the coupling piece of a turnbuckle.

In addition to longitudinal through bore 25, the body 24 also has a lateral through bore 26 which is positioned mid way along the length of body 24. Lateral bore 26 has associated threads such as being threaded along its length or a nut secured to its adjacent upper or lower surface. Lateral bore 26 intersects and crosses through longitudinal bore 25 so that the left hand treads of bore 25 are on one side of bore 26 and the right hand thread are on the other side.

In assembly, rods 30 and 32 are each screwed into body 24 the same distance and since the thread pitch is the same on each, when body 24 is inserted into drain pipe 12 and rotated, lateral bore 26 will be centered when pointed rod ends 34 and 36 are seated against the inner wall of drain pipe 12. Of course care must be taken to place body 24 to lie along a diametric line and the rotation of body 24 should be stopped so that bore 26 extends vertically when body 24 is finally positioned.

Thrust bolt 20 is passed through center aperture 18 of drain screen 14 and then end 28 of bolt 20 is threaded into the threads associated with bore 26 and tightened down to hold drain screen 14 firmly in place. As previously stated, because thrust bolt 20 has a non-standard head 22, the bolt 20 cannot be removed and drain screen 14 will be kept in place to prevent scrap and debris from entering the drain pipe 12.

Drain lock 10 is installed using an adjustable tool 50. The tool includes a block 60 and two identical arms 70, and a pair of set screws. The tool is configured to adjust to install into drains ranging from approximately two to eight inches in diameter.

Referring now to FIG. 4, block 60 defines a first through hole 62 and a second through hole 64 with each through hole being parallel to an axis-X. Through hole 62 is intersected by a hole 63 parallel to an axis-Y, perpendicular to axis-X, and configured for the positioning of a set screw 66. Through hole 64 is similarly intersected by a hole 65 also parallel to an axis-Y, perpendicular to axis-X, and configured for the positioning of one set screw 66. An axis-Z is defined by block 60 being perpendicular to axis-X and axis-Y. In one preferred embodiment, block 60 has approximate dimensions in inches for height of 0.75, width of 1.0, and length of 1.5. Block 60 can be fabricated from any suitable material to include wood, plastic, or metal.

Each of the identical arms 70 include a first member 72, a second member 74, a third member 76, and a fourth member 78. First members 72 are configured for positioning in holes 62 and 64. Second member 74 hangs downward. Fourth member 78 includes a tip 79 configured for positioning into holes 31 and 33 of rods 30 and 32, respectively. In one preferred embodiment each arm 70 has dimensions in inches for first member 72 of 3.5, second member 74 of 6.0, third member 76 of 0.5, and fourth member 78 of 0.46. First member 72 is preferably made of rod having a diameter of approximately 0.125 and the remaining members of arm 70 having a diameter of approximately 0.06. Arms 70 can be fabricated from any suitable material to include metals, metal alloys, composites, and plastics. Arms 70 can be fabricated as a flexible readily bent, rigid, or semi-rigid member.

Figure 5:
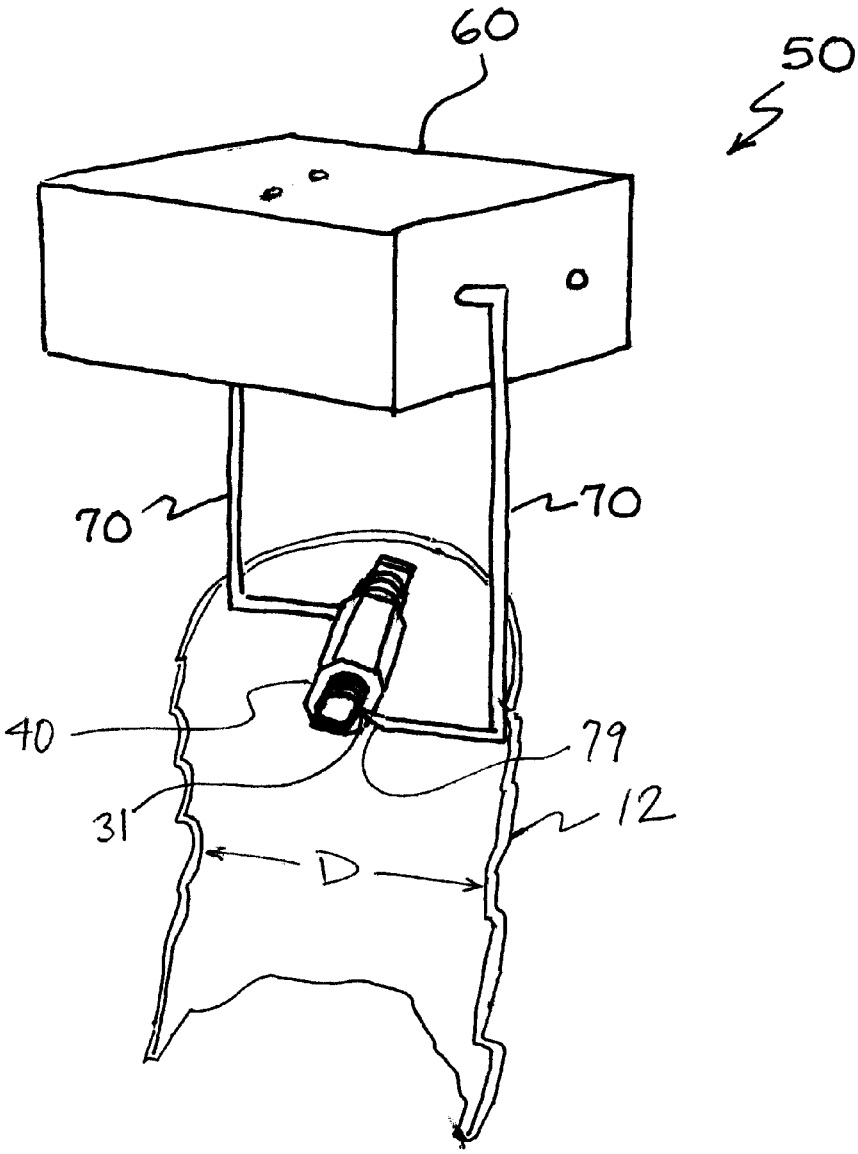
FIG. 5 is a perspective view of one application of the tool of FIG. 4 in use with a cross member of FIG. 1.
Figure 6:
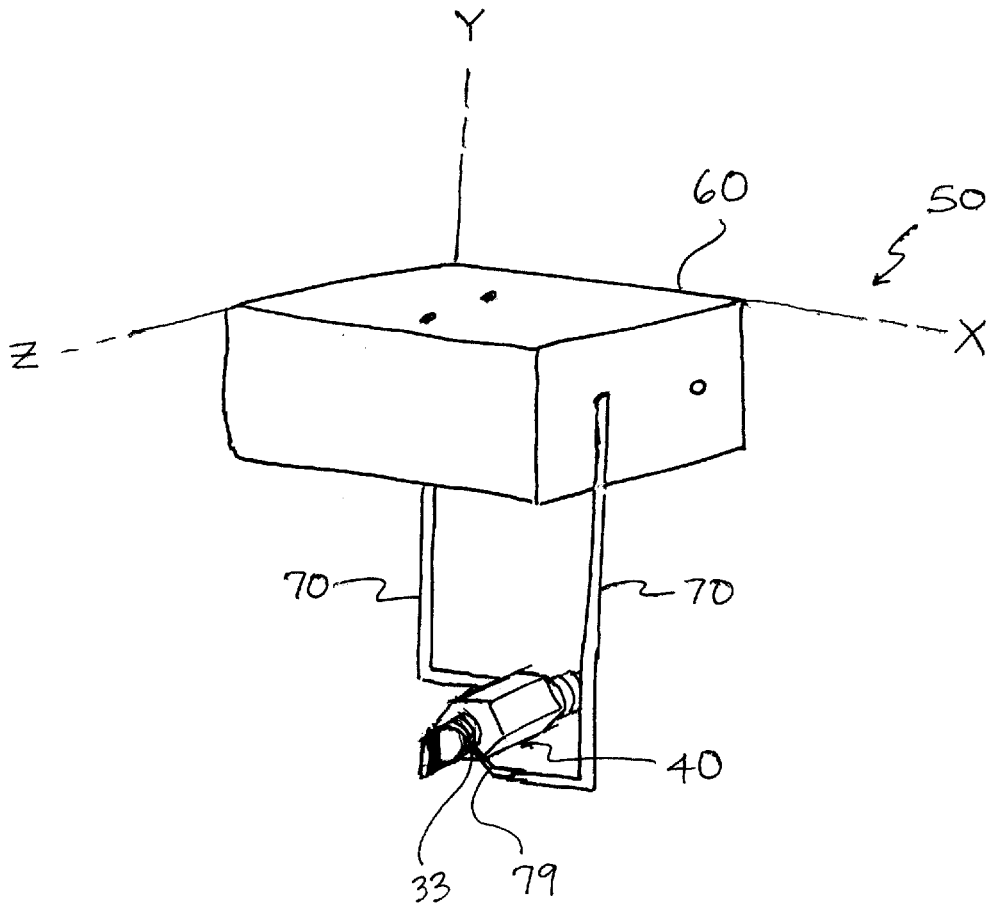
FIG. 6 is a perspective view of one application of the tool of FIG. 4 in use with the cross member of FIG. 1.

As shown in FIGS. 4–6, in operation, a diameter-D of drain pipe 12 is measured and the dimension decremented to account for fitting into drain pipe 12 and the distance from ends 34 and 36 to their respective holes 33 and 35. Rods 34 and 36 are then rotated to extend to the desired combination of dimension and positioning of holes 31 and 33, respectively. Arms 70 are then positioned in block 60 such that tips 79 are aligned with the holes 31 and 33. Arms 70 are preferably positioned such that cross member 40 is aligned with an axis-Z. Arms 70, however, can be to set cross member 40 transverse to axis-Z which can advantageously assist installation during instances when access to drain pipe 12 is restricted. Set screws 66 are positioned in holes 63 and 65 to fix arms 70 in position along the axis-X.

Cross member 40 or assembled body 24 and rods 30 and 32 are positioned using holes 31 and 33 onto tips 79. Arms 70 are configured to rotate in holes 62 and 64 generally parallel to axis-X to accommodate the further extension of rods 30 and 32 as body 24 is rotated. Tool 50 is configured to support the full range of application of drain lock 10 in drain pipes from approximately two to eight inches.

Tool 50 is held by block 60 and the assembled cross member and arms 70 are then lowered into drain pipe 12 the desired distance for the positioning of cross member 40. The second member of arm 70 preferably includes markings 71 to indicate the depth at which cross member 40 is being installed. This also ensures thrust bolt 20 has sufficient length to reach cross member 40. In one preferred embodiment, arms 70 can extend approximately five and a half inches into drain 12. A wrench (not shown) is then engaged with body 24 and rotated to rotate body 24 and simultaneously move rods 30 and 32 outward into contact with the inside wall of drain pipe 12. When ends 34 and 36 are configured with a chisel shape, the flat sharpened edges cut or dent an elongate V-shape recess into the inside wall of drain pipe 12. The recess effectively locks cross member 40 in position as a result of the length of cross member 40 being greater than the inside diameter of drain 12. This creates a superior connection to a simple friction based connection or a point which can readily penetrate through the wall of drain pipe 12 and cause undesirable leaks into the surrounding foundation or structure.

Bolt 20 is then positioned through drain screen 14 and threaded into hole 26 of body 24. The requirement to use a special tool to interface with and turn bolt 20 increases the security of the installation of the drain screen 14.

Drain lock 10 is removed from drain pipe 12 in a reverse sequence wherein bolt 20 and drain screen 14 are removed and tool 50 is connected to rods 30 and 32. A wrench then engages body 24 and withdraws rods 30 and 32 toward the center of the drain and out of their respective recesses. Tool 50 and cross member 40 are then withdrawn from drain pipe 12.

What is claimed is:

1. A drain lock system adapted for securing a drain screen in position comprising:

a drain lock including a thrust bolt adapted for positioning through the drain screen;

a cross member including an elongated body and two opposingly threaded rods, the body defining a longitudinal hole therethrough and a perpendicular transverse hole therethrough, the longitudinal hole having left hand threads associated with a first end of the body thereof and right hand threads with a second end of the body thereof, the perpendicular transverse hole defined in the body being configured for receiving the thrust bolt, a first rod having a left handed thread configured for being received by the first end of the body and a second rod having a right handed thread configured for being received by the second end of the body, the rods having ends having a chisel shaped edge;

a nonstandard head positioned on the thrust bolt so that it is removable with a special tool and when said head is firmly holding said drain screen in place an entry end, said drain screen is held against unauthorized removal; and an installation tool including a block and two arms, the block including two holes for positioning of the arms, the arms including tips configured for engaging with holes defined in the first rod and the second rod, the tool being configured to fix the relative position of the rods during the installation of the cross member, the arms being configured to rotate in the holes defined in the block to accommodate the movement of the rods during a portion of the installation.

2. The drain lock system of claim 1 in which said perpendicular transverse hole is threaded along its length.

3. The drain lock system of claim 1 in which said longitudinal hole is threaded along its length.

4. The drain lock system of claim 1, wherein the tool includes arms slidably positionable within the holes defined in the block.

5. The drain lock system of claim 4, wherein the arms are connected to the first rod and second rod, the arms being configured to rotate in the holes in the block to accommodate the movement of the first rod and the second rod during installation and removal of the cross member.

6. The drain lock system of claim 4, wherein the arms can be adjustably positioned within the holes defined by the block to adjust the orientation of the cross member relative to the tool.

7. The drain lock system of claim 1, wherein the arms include markings indicating the depth of the cross member when positioned into a drain pipe.

8. A drain lock system adapted for securing a drain screen in position comprising:

a drain lock including a thrust bolt adapted to positioning through the drain screen;

a cross member including an elongated body and two opposingly threaded rods, the body defining a longitudinal hole therethrough and a perpendicular transverse hole therethrough, the longitudinal hole having left hand threads associated with a first end of the body thereof and right hand threads with a second end of the body thereof, the perpendicular transverse hole defined in the body being configured for receiving the thrust bolt, a first rod having a left handed thread configured for being received by the first end of the body and a second rod having a right handed thread configure for being received by the second end of the body, the rods having ends having a chisel shaped edge, wherein the longitudinal hole is threaded along its length and the perpendicular hole is threaded along its length;

a nonstandard head positioned on the thrust bolt so that it is removable with a special tool and when said head is firmly holding said drain screen in place over an entry end, said drain screen is held against unauthorized removal; and an installation tool including a block and arms, the block including holes for positioning of the arms, wherein the tool includes arms slidably positionable within the holes defined in the block, and wherein the arms are connected to the first rod and second rod, the arms being configured to rotate in the holes in the block to accommodate the movement of the first rod and the second rod during installation and removal of the cross member.

* * * * *